United States Patent [19]

Kamstrup-Larsen

[11] 4,029,464

[45] June 14, 1977

[54] ROTARY KILN FOR PRODUCING A BLOATED CLAY PRODUCT

[75] Inventor: Harry Kamstrup-Larsen, Vanlose, Denmark

[73] Assignee: Leca Trading & Concession A/S, Copenhagen, Denmark

[22] Filed: Sept. 15, 1975

[21] Appl. No.: 613,555

[30] Foreign Application Priority Data

Sept. 13, 1974 Denmark ..... 4825/74

[52] U.S. Cl. ..... 432/118; 432/119

[51] Int. Cl.² ..... F27B 7/14

[58] Field of Search ..... 432/118, 119

[56] References Cited

UNITED STATES PATENTS

| | | | |
|---|---|---|---|
| 1,544,504 | 6/1925 | Tomlinson | 432/119 |
| 1,817,421 | 8/1931 | Saito | 432/119 |
| 1,920,677 | 8/1933 | Burke | 432/119 |
| 1,977,117 | 10/1934 | Debuch | 432/118 X |
| 2,553,464 | 5/1951 | McNeill | 432/118 |
| 3,124,338 | 3/1964 | Harris | 432/118 |
| 3,950,861 | 4/1976 | Weimer et al. | 432/118 |

FOREIGN PATENTS OR APPLICATIONS

| | | | |
|---|---|---|---|
| 904,512 | 2/1954 | Germany | 432/118 |
| 80,565 | 8/1952 | Norway | 432/119 |

*Primary Examiner*—John J. Camby
*Attorney, Agent, or Firm*—Cushman, Darby & Cushman

[57] ABSTRACT

The kiln comprises a slowly rotating drying-kiln section and a relatively quickly rotating kiln-section, a transition zone being arranged in the middle of the kiln. The transition zone comprises shovel-shaped bricks and intermediate bricks. The shovel-shaped bricks comprise projecting portions provided with especially shaped surfaces.

16 Claims, 9 Drawing Figures

Figure 6:
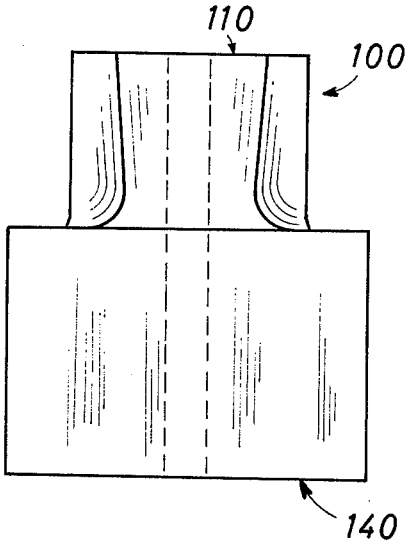

Fig. 1
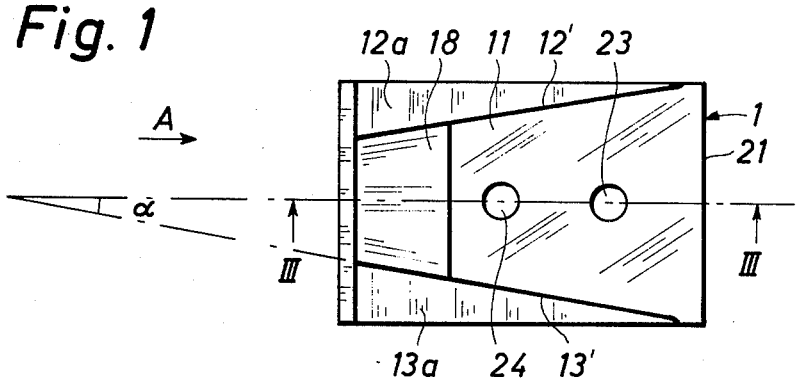
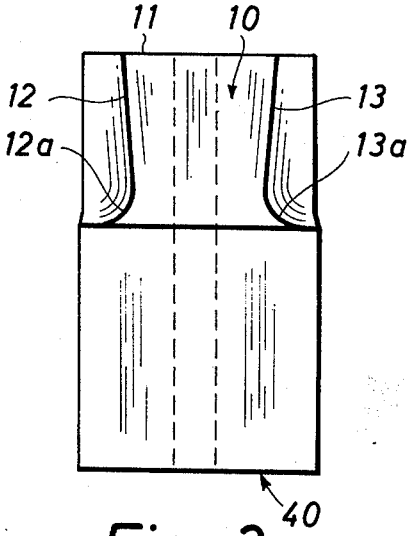
Fig. 2
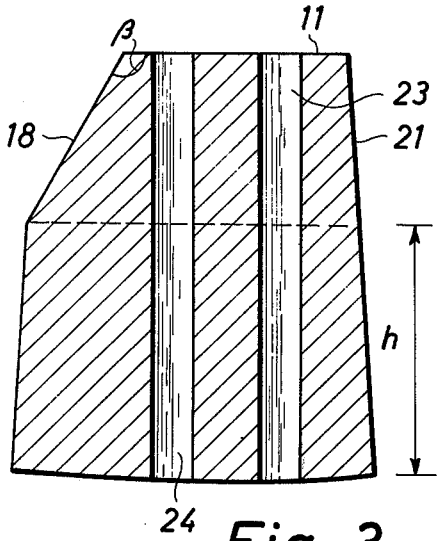
Fig. 3
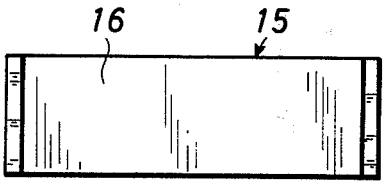
Fig. 4
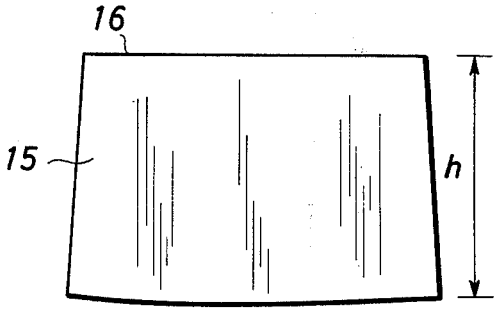
Fig. 5

ROTARY KILN FOR PRODUCING A BLOATED CLAY PRODUCT

The invention relates to a rotary kiln for producing a bloated clay product on clay or clay slate.

It is known to provide the lining of the transition zone in a rotary kiln consisting of a drying-kiln section and a burning-kiln section with shovel-shaped bricks, i.e. bricks to carry the clay nodules from the bottom of the kiln and somewhat upwards the walls of the kiln in order to mix the nodules. The shovel-shaped bricks are arranged in groups, the spacing of these groups being rather large. Each group of bricks is provided with metallic protective portions in order to prevent wear. In order to utilize the bloating capacity of the clay completely, care has to be taken that the clay in the drying-kiln section is heated from the ambient air temperature to 300° – 600° C in a relatively long period of time, and subsequently, in a relatively short period of time, preferably 15 – 30 minutes, the clay is heated to 1150° – 1175° C in the transition zone; then the burning of the clay must take place. If the capacity of the kiln is to be large, great care has to be taken that the heat transfer between the lining and the nodules is increased. The heat transfer of known linings is not quite satisfactory.

An object of the present invention is to provide a rotary kiln comprising a slowly rotating drying-kiln section and a relatively quickly rotating burning-kiln section arranged adjacent the drying-kiln section, the rear part of the drying-kiln section and the front part of the burning-kiln section forming a transition zone, the lining of which among other things contains shovel-shaped bricks. This device permits a more efficient heat transfer in the transition zone than prior to art devices, and at any time ensures that the nodules carried by the shovel-shaped bricks will roll down on the mass of nodules moving upwardly.

The rotary kiln according to the present invention is characterized in that each shovel-shaped brick comprises a portion projecting inwardly towards the center-line of the kiln, the projecting portion being defined by a top surface substantially perpendicular to a radius vector of the shovel-shaped brick, a plurality of inclined surfaces extending from said top surface, such inclined surfaces being e.g. a front surface inclined in relation to the tangential direction of the kiln, two side surfaces, and a rear surface. The number of the shovel-shaped bricks is preferably large, and said shovel-shaped bricks may be separated by intermediate bricks, the height of which is smaller than the height of the shovel-shaped bricks measured in the radial direction of the kiln. As a result of this invention a larger and more efficient heat transferring surface is obtained, the projecting portion of the shovel-shaped bricks presenting a large contact surface by which the capacity of the rotary kiln is increased over prior art devices. Furthermore, it is ensured that the nodules when drawn to a certain level in the kiln will slide down the inclined front surface, and subsequently roll on the mass of nodules moving upwardly.

According to the invention the side surfaces of the projecting portion may be undercut. This embodiment has proved particularly advantageous since there is no tendency for the nodules to be wedged between the shovel-shaped bricks.

The undercuts may be in the range of 2° – 12°, preferably in the range 5° – 10°.

Moreover according to the present invention the side surfaces of the projecting portion may extend into the top surface of the adjacent intermediate bricks via curved surfaces, preferably surfaces substantially curved cylindrically. This, the spacing between two adjacent shovel-shaped bricks form half of a rounded funnel, in which the nodules may easily be carried up a portion of the wall of the kiln.

According to the present invention the secant of each inclined surface and the top surface of the projecting portion may form an angle of 5° – 35° with the tangential direction of the kiln, by which the funnel shape becomes clearly evident.

In a preferred embodiment of the invention the top surface of each intermediate brick is planar and substantially perpendicular to a radius vector of the brick.

Furthermore according to the invention the front surface of the projecting portion may form an angle of 110° – 130° with the top surface of the shovel-shaped brick and extend forwardly and outwardly as the front surface of the projection portions is inclined in relation to the tangential direction of the kiln. In practice this inclination has resulted in release of the nodules at an appropriate moment.

According to the invention the rear surface of the projecting portion may be situated in a radial plane of the kiln. This results in a very simple construction.

Further according to the invention each shovel-shaped brick may have a base part the width of which is at least equal to the width of the projecting portion measured in the longitudinal direction of the kiln, the width of a shovel-shaped brick plus the width of an intermediate brick being constant, by which relatively easy assembling of the shovel-shaped bricks is obtained. Moreover according to the invention the width of a shovel-shaped brick may be of the magnitude twice the width of an intermediate brick. As a result a suitable distribution of the projecting portions of the lining is obtained.

Furthermore the shovel-shaped bricks may be reinforced containing at least two substantially radially directed bodies of fireproof steel. This results in a greater heat capacity and greater strength of the bodies.

According to the invention the shovel-shaped bricks and the intermediate bricks may be alternately arranged as seen in the longitudinal direction as well as in the tangential direction of the kiln. Thus, an efficient distribution of the projecting portions of the lining is obtained.

Finally according to the invention the base part of the shovel-shaped bricks may on each side extend somewhat beyond the projecting portion, i.e. a distance corresponding to half the distance between two succeeding projecting. portions as seen in the longitudinal direction of the kiln, and the intermediate bricks may be omitted. This results in a very simple construction, only one type of bricks being necessary to ensure that the projecting portions do not get to close.

Figure 7:
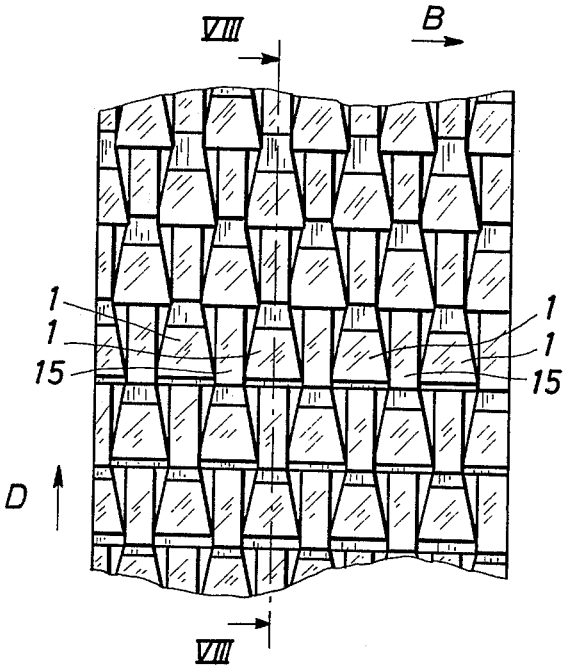
Figure 8:
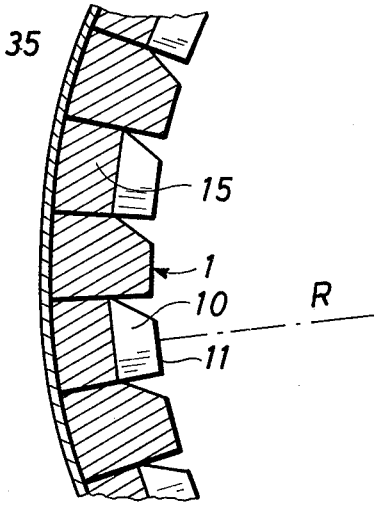
Figure 9:
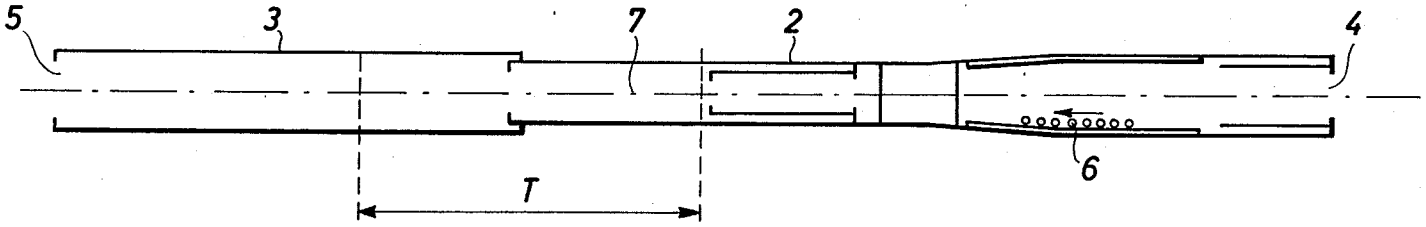

The invention will be described below with reference to the accompanying drawings in which FIG. 1. is a plan view from the center-line of the kiln, showing a shovel-shaped brick according to the invention, FIG. 2 is an elevational view in the direction of arrow A in FIG. 1 of the shovel-shaped brick of FIG. 1, FIG. 3 is a sectional view taken along the line III—III of FIG. 1, FIG. 4 is a plan view from the center-line of the kiln, of an intermediate brick of the invention, FIG. 5 is an elevational view of the intermediate brick of FIG. 4, FIG. 6 is another embodiment of the shovel-shaped brick of the present invention being somewhat wider than the brick shown in FIG. 2, FIG. 7 is a view from the center-line of the kiln of the lining of the present invention inside the kiln, FIG. 8 is a sectional view of the lining of FIG. 7 taken perpendicularly to the center-line of the kiln, the wall of the kiln being shown too, and FIG. 9 is a diagrammatic view of the kiln in which the shovel-shaped bricks mentioned above are mounted in the transition zone.

The shovel-shaped brick 1 shown in FIG. 1 is together with a great number of similar bricks part of a lining in a transition zone T of the rotary kiln shown in FIG. 9. Said kiln consists of a drying-kiln section 2 and a burning-kiln section 3. The burning-kiln section may rotate quicker than the drying-kiln section. The clay or clay slate 6, on which the final bloated clay produced, is fed into the kiln at the feed end 4 thereof, and the final product is discharged at the discharge end 5. In operation of the kiln it is most efficient if the clay in the drying-kiln section 2 is heated from the ambient air temperature to 300°–600° C in a relatively long period of time, preferably a couple of hours, and if the clay in the transition zone T is subsequently heated from 300° – 600° C to 1150° – 1175° C in a relatively short period of time, preferably 15 – 30 minutes. This involves the highest possible utilization of the bloating capacity of the clay. In order to obtain the maximum operating capacity of the rotary kiln, the transfer of heat in the transition zone T must be very efficient and consequently the shovel-shaped bricks 1 according to the invention will then be of great assistance.

As shown in FIGS. 1 and 2 each shovel-shaped brick 1 has a projecting portion 10 facing the center-line 7 of the kiln, said projecting portion being defined by a top surface 11 substantially perpendicular to radius vector R of the brick illustrated in FIG. 8. Furthermore the projecting portion 10 is defined by two side surfaces 12 and 13, as illustrated in FIG. 2, said side surfaces being rounded at their lower ends **12*a* and 13*a*. The rounded ends may be cylindrical if desired. The secants 12' and 13' between the inclined surfaces 12 and 13 and the top surface 11, as illustrated in FIG. 1, of the projecting portion 10** form an angle $\alpha$ with the tangential direction of the kiln of 5° – 35°.

Furthermore the shovel-shaped brick 1 has a front surface 18 inclined in relation to the tangential direction of the kiln, said front surface forming an angle $\beta$ of preferably 110° – 130°. Finally the projecting portion 10 has a rear surface 21, as illustrated in FIGS. 1 and 3, usually placed in a radial plane in the kiln. The side surfaces 12 and 13 are undercut as shown in FIG. 2, and the undercut angle is 2° – 12°, preferably 5° – 10°. Usually the curved surfaces **12*a* and 13*a* extend into the top surface 16 of an intermediate brick 15, intermediate bricks usually being arranged between the shovel-shaped bricks 1, as shown in FIG. 7**. Usually the height *h* of the intermediate bricks is, i.e. the dimension measured in the radial direction of the kiln, corresponds to the height of the shovel-shaped bricks 1 less the height of the projecting portion 10, i.e. the height of the base part 40 of the shovel-shaped brick. Usually the top surface 16 of the intermediate brick 15 is substantially perpendicular to the radius vector of the brick.

However, the intermediate bricks may be omitted; if these bricks are omitted each shovel-shaped brick 1 has to be widened considerably, see, for example, the shovel-shaped brick 100 in FIG. 6. The projecting portion 110 corresponds to the portion 10 of FIGS. 1 and 2, whereas the width of the base part 140 of the shovel-shaped brick 100 corresponds to the base part 40 of the shovel-shaped brick 1 of FIG. 2 plus the width of the intermediate brick 15 of FIG. 4. When arranging many of the shovel-shaped bricks 100 shown in FIG. 6 close to each other in the longitudinal direction of the kiln, with the front surface of said bricks extending substantially in the tangential direction of the kiln, the spacing between the projecting portions 110 will be equal to the spacing between the projecting portions in a lining consisting of the bricks shown in FIGS. 2 and 4. Usually each shovel-shaped brick of either of the above types has a width at least equal to the width of the projecting portion measured in the longitudinal direction of the kiln. If the width of a shovel-shaped brick plus the width of an intermediate brick is constant, a quite uniform pattern of projecting portions is formed as shown in FIG. 7.

In order to strengthen the shovel-shaped bricks 1 these may be provided with two inwardly substantially radially directed reinforcing bodies 23 and 24, as illustrated in FIG. 3, of fireproof steel. The reinforcing bodies are indicated by the dotted lines in FIG. 2. The shovel-shaped brick 100 shown in FIG. 6 may be reinforced too, the reinforcing bodies being indicated by dotted lines.

FIG, 7 is showing the alternating arrangement of the shovel-shaped bricks 1 and the intermediate bricks 15 in the longitudinal direction of the kiln; the longitudinal direction is indicated by the arrow B. However, the shovel-shaped bricks 1 and the intermediate bricks 15 are also alternately arranged along the inside surface of the kiln, i.e. in the longitudinal direction indicated by the arrow D. FIG. 8 clearly shows how the projecting portions 10 of the shovel-shaped bricks 1 are higher than the intermediate bricks 15, and how all the bricks are secured to the wall of the kiln 35.

When the lining in the transition zone T of the kiln according to the invention is made of the shovel-shaped bricks, e.g. when using the special intermediate bricks, a very efficient heat transfer in the transition zone is obtained, the contact surface of the transition zone being increased in relation to the clay nodules. The heat transferring surface is heated by the flue gases streaming from the discharge end 5 towards the feed end 4 in counterflow to the nodules 6. When the rotary kiln is rotating, the nodules will not be drawn so high from the lining of the kiln that they will fall down and break; on the contrary they will roll away from the wall of the kiln relatively early, but they will settle in the bottom of the kiln. Since the side surfaces of the shovel-shaped bricks are undercut a sort of half funnel will be formed between adjacent shovel-shaped bricks, said funnels having a tendency to carry along the nodules, however releasing them rather quickly, i.e. when the funnels have reached a certain level above the bottom. By using the lining according to the invention a considerably increased capacity of the kiln is achieved as described above. This clearly appears from the following test results obtained by means of two rotary kilns I and II. These kilns only differ in that during the months of April, May and June the first-mentioned kiln (I) was provided with the lining according to the invention in its transition zone T whereas the other kiln (II) was unchanged. Both kilns were operating on the same type of clay. The figures of the table below indicates more precisely the average capacity per day ($m^3$/24h) for each of the months January, February, March, April, May and June, said capacity being the output of the bloated clay. The purpose of the test was to obtain maximum capacity but the quality of the output of the clay was to be maintained constant.

| Kiln | Jan. | Feb. | Mar. | Apr. | May | June |
|---|---|---|---|---|---|---|
| I | 568 | 613 | 612 | 824 | 859 | 845 |
| II | 678 | 744 | 789 | 869 | 856 | 826 |

From the table it appears that the means value of the capacity figures covering January, February and March of kilns I and II are 598 and 737 respectively, whereas the corresponding figures of the two kilns in the period April, May and June are 843 and 850 respectively. The capacity increase of the kiln I was 843 − 598/598 . 100 ≈ 41%, whereas the capacity increase of the kiln II was only 850 − 737/737 . 100 ≈ 15%. In other words, if the kiln I during the months April, May and June had not been provided with a lining according to the invention the increase would only be about 15%. By means of the inventionn the increase reached 41%. This percentage indicates the great importance of the invention.

The above-mentioned rotary kiln may be changed in many ways without deviating from the scope of the present invention as defined by the following claims. The above-mentioned embodiments only serve to illustrate the invention and are not intended to limit the scope of the protection.

What is claimed is:

1. A rotary kiln for producing a bloated clay product on clay or clay slate, and comprising a tubular drying-kiln section slowly rotating about its axis and a tubular burning-kiln section which rotates relatively rapidly about its axis, said burning-kiln section being arranged adjacent the drying-kiln section with the rear part of the drying-kiln section being adjacent and in communication with the front part of the buring-kiln section, the rear part of the drying-kiln section and the front part of the burning-kiln section forming a transition zone, said transition zone having a lining which contains shovel-shaped bricks, each shovel-shaped brick comprising a portion projecting inwardly towards the center-line of the kiln, the projecting portion being defined by a top surface substantially perpendicular to a radius of the kiln, a plurality of inclined surfaces extending from said top surface, such inclined surfaces including a front surface inclined in relation to the tangential direction of the kiln, two side surfaces, and a rear surface.

2. A rotary kiln as claimed in claim 1 wherein the side surfaces of the projecting portion are undercut.

3. A rotary kiln as claimed in claim 2 wherein the undercuts are in the range of 2° – 12°.

4. A rotary kiln as claimed in claim 2 wherein the undercuts are in the range of 5° – 10°.

5. A rotary kiln as claimed in claim 1 wherein the side surfaces of the projecting portion extend into the top surface of the adjacent intermediate brick via curved surfaces.

6. A rotary kiln as claimed in claim 5 wherein the curved surfaces are substantially cylindrical.

7. A rotary kiln as claimed in claim 1 wherein the secant of each inclined surface and the top surface of the projecting portion form an angle of 5° – 35° with the tangential direction.

8. A rotary kiln as claimed in claim 1 wherein the front surface of the projecting portion forms an angle of 110° – 130° with the top surface of the shovel-shaped brick and extends forwardly and outwardly as it is inclined in relation to the tangential direction of the kiln.

9. A rotary kiln as claimed in claim 1 wherein the rear surface of the projecting portion is situated in a radial plane of the kiln.

10. A rotary kiln as claimed in claim 1 wherein the shovel-shaped bricks are reinforced by at least two substantially radially directed bodies of fireproof steel disposed within each shovel-shaped brick.

11. A rotary kiln as claimed in claim 1 wherein each shovel-shaped brick has a base part which on each side extends somewhat beyond the projecting portion a distance corresponding to half of the distance between two succeeding projecting portions seen in the longitudinal direction of the kiln.

12. A rotary kiln as claimed in claim 1 wherein adjacent shovel-shaped bricks are separated by intermediate bricks the height of which is smaller than the height of the shovel-shaped bricks measured in the radial direction of the kiln.

13. A rotary kiln as claimed in claim 12 wherein the top surface of each intermediate brick is planar and substantially perpendicular to the radius vector of the brick.

14. A rotary kiln as claimed in claim 12 wherein each shovel-shaped brick has a base part the width of which is at least equal to the width of the projecting portion measured in the longitudinal direction of the kiln, the width of a base part of a shovel-shaped brick plus the width of an intermediate brick being connstant.

15. A rotary kiln as claimed in claim 12 wherein the width of a shovel-shaped brick is of the magnitude twice the width of an intermediate brick.

16. A rotary kiln as claimed in claim 12 wherein the shovel-shaped bricks and the intermediate bricks are alternately arranged in the longitudinal direction and in the tangential direction of the kiln.

* * * * *